United States Patent [19]

Zwagerman

[11] Patent Number: 4,833,856

[45] Date of Patent: May 30, 1989

[54] CONSTRUCTIVE ASSEMBLY COMPRISING SEPARATE ASSEMBLY PARTS

[76] Inventor: Jan Zwagerman, Middenweg 127a, 1394 AG Nederhorst de Berg, Netherlands

[21] Appl. No.: 132,998

[22] Filed: Dec. 15, 1987

[30] Foreign Application Priority Data

Dec. 16, 1986 [NL] Netherlands ..... 8603202

[51] Int. Cl.[4] ..... A63H 33/08; A63H 33/12; E04C 1/10

[52] U.S. Cl. ..... 52/593; 52/564; 52/585; 52/604; 446/122; 446/127

[58] Field of Search ..... 52/285, 426, 427, 562–565, 52/571, 572, 583, 585, 586, 589–595, 604, 605, 608; 446/111, 115, 122, 125, 127

[56] References Cited

U.S. PATENT DOCUMENTS

| | | | |
|---|---|---|---|
| 3,609,926 | 10/1971 | Muse | 52/604 X |
| 3,791,090 | 2/1974 | Kniefel | 446/127 X |
| 4,258,522 | 3/1981 | Amaral | 52/591 |
| 4,367,615 | 1/1983 | Feldman | 52/583 |
| 4,565,043 | 1/1986 | Mazzarese | 52/593 |

FOREIGN PATENT DOCUMENTS

| | | | |
|---|---|---|---|
| 50690 | 2/1941 | France | 52/583 |
| 2396135 | 3/1979 | France | 52/593 |
| 285405 | 9/1952 | Switzerland | 52/594 |

*Primary Examiner*—D. A. Scherbel
*Assistant Examiner*—Anthony W. Williams
*Attorney, Agent, or Firm*—Lorusso & Loud

[57] ABSTRACT

A constructive assembly is provided comprising separate assembly parts with side-projections and corresponding side-recesses. Moreover the assembly parts comprise cooperating recesses at their top for accommodating coupling elements for holding together assembled assembly parts.

9 Claims, 2 Drawing Sheets

CONSTRUCTIVE ASSEMBLY COMPRISING SEPARATE ASSEMBLY PARTS

BACKGROUND OF THE INVENTION

The invention relates to a constructive assembly comprising separate assembly parts.

With known constructive assemblies of this type coupling devices are applied in assembling the separate assembly parts that are locked by means of fastening means. The application of these fastening means is complicated and time-consuming. Further special tools are required. This makes the known constructive assemblies far from handy in using them.

It is an object of the invention to provide a constructive assembly comprising separate assembly parts wherein joining the separate assembly parts can be carried out in a quick and easy way.

SUMMARY OF THE INVENTION

Herefore each assembly part comprises at least one side-projection positioned at one side wherein the side-projection of the assembly part releasably grips into a side-recess of an adjoining assembly part, whereas each assembly part has at its upper side recesses that all join corresponding recesses of the adjoining assembly part and in which releasable coupling elements for holding together the assembly parts are positioned, said coupling elements bridging the joint between the adjoining assembly parts.

Assembling the separate assembly parts into a constructive assembly according to the invention is therefore extremely simple, because only the side-projections of the one assembly part have to be applied in the corresponding side recesses of the adjoining assembly part, whereafter the coupling elements are placed into the recesses that are defined by each pair of joining recesses of two adjacent assembly parts. Once applied the coupling elements maintain their position due to the gravity force so that the application of a locking is superfluous. Further there is no need for extra tools in applying the coupling elements.

According to a preferred embodiment of the constructive assembly according to the invention the lower side of each side projection extends outwardly and inclined downwardly whereas the lower side of each side recess extends inwardly and inclined downwardly.

As a result the adjoining assembly parts at their lower sides too are secured against a relative transversal displacement. Such a displacement now only can be carried out if the assembly parts would at the same time be displaced relatively in their boundary face, but this is prevented by the gravitational force.

It is advantageous if each assembly part comprises at least two regularly distributed side-projections and side-recesses and at each upper side-edge at least two regularly divided recesses.

This feature makes it possible that assembly parts can be off-set longitudinally relative to each other whereby a constructive assembly can be provided wherein not only series of side by side positioned assembly parts but also series of respective longitudinally aligned assembly parts can be provided.

An effective operation of the coupling elements can be provided if according to a handy embodiment of the constructive assembly according to the invention the recesses are tapering towards their ends. For example it is possible that the recesses are T-shaped, wherein the leg of the T extends perpendicularly to the respective upper sideedge, whereas each coupling element is I-shaped.

Thus two adjoining recesses of adjacent assembly parts define a I-shaped recess in which the I-shaped coupling element can be accommodated. The flange portions of the I-shaped coupling elements hereby prevent effectively that the assembly parts move apart transversally.

Further it is very advantageous if each assembly part comprises, at the corners of the side having the side-projection or projections, coupling parts defining the outer-dimensions of the assembly part, whereas the opposite side comprises holes for receiving such coupling parts of adjoining assembly parts.

These coupling parts ensure that the side-projections do not form the outer-limits of said side and do therefore not provide an obstruction when stacking separate assembly parts one on the top of the other.

In view of standardization it is preferred if the outer-dimensions of the assembly part correspond with standard container dimensions, such as a container height of 6, 6½, 8 or 8⅜ feet. Like this the separate assembly parts can be transported by each conveyor system fit for containers or can be stored in each room fit for containers, wherein the coupling parts can be attached to standard connecting parts of the conveyor system or the like.

If the assembly parts have a floating capacity and a positive metacenter height it is extremely simple to join assembly parts to a floating and a very stable constructive assembly. This constructive assembly then constitutes as it were a pontoon having an extremely wide range of application possibilities. As example can be mentioned a pontoon for forming a floating crane.

Further the invention relates to an assembly part for application in an constructive assembly according to the invention.

Hereafter the invention will be explained further by means of the drawing, in which an embodiment of the constructive assembly according to the invention is illustrated.

DESCRIPTION OF THE PREFERRED EMBODIMENTS

Figure 1:
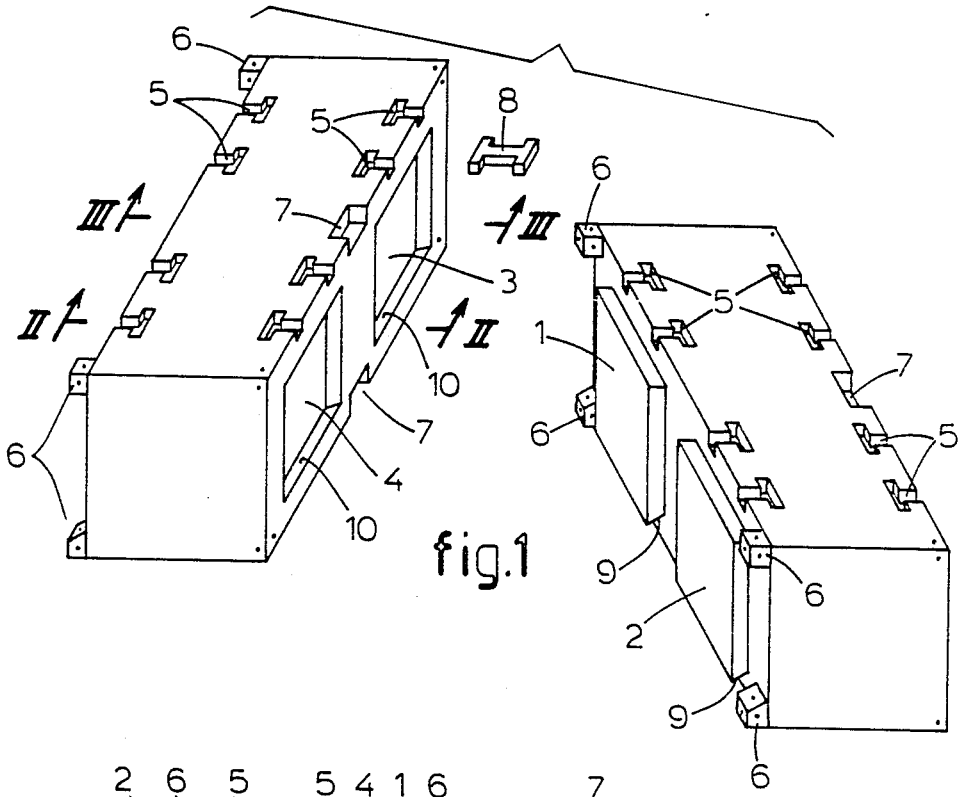
FIG. 1 shows a part of a constructive assembly according to the invention before joining to separate assembly parts.

The assembly parts shown in FIG. 1 at one side are provided with side-projections 1, 2 and comprise at the opposite side side-recesses 3, 4. At the upperside of each assembly part recesses 5 are provided having a T-shape. As appears clearly from FIG. 1 the recesses 5 are provided at both longitudinally extending upper side-edges, wherein of each recess 5 the leg of the T extends perpendicularly to the respective upper side-edge. The side-projections 1, 2, the side-recesses 3, 4 as well as the recesses 5 are regularly divided along the sides and upperside, respectively, of the assembly part. The lower side of each projection 1, 2 extends inclined for assembling adjacent assembly parts (as will appear later).

At the corners of the side of the assembly part comprising the side-projections 1, 2 coupling parts 6 are provided offering the assembly parts standard container dimensions. These coupling parts can, if desired, be releasably mounted to the assembly part, as will be explained further later on with respect to FIG. 4. At the opposite side of the assembly part holes 7 are provided for accommodating the coupling parts 6 of an adjacent assembly part if these assembly parts are joined. Instead of the embodiment shown it is possible too that these holes 7 are located at the corners of the opposite side.

Finally FIG. 1 shows a coupling element 8, that in a way to be described hereafter holds together the assembly parts after that these have been assembled to a constructive assembly.

During assembling both assembly parts shown in FIG. 1 the side projection 1 is accommodated into the side recess 4 whereas two of the coupling parts 6 of the righthanded assembly part fill up for one half the holes 7 of the left-handed assembly part. Next coupling elements 8, of which only one is illustrated in FIG. 1, are applied into the adjoining corresponding recesses 5 of the adjacent assembly parts, whereafter these coupling elements bridge the joint between the adjacent assembly parts and hold these together.

For the recesses 5 taper towards their ends, namely having a T-shaped form, a coupling element accommodated herein will be I-shaped and will effectively hold together the assembly parts without special locking devices.

Correspondingly it is possible to connect a further assembly part to the left-handed assembly part as seen in FIG. 1 behind the right-handed assembly part, wherein the side projection 2 of this not shown further assembly part is applied into the side recess 3 of the left-handed assembly part. Like this the constructive assembly can be expanded unlimited, wherein at the left side of the in FIG. 1 shown left-handed assembly part as well as at the right side of the in FIG. 1 shown right-handed assembly part as well as in the elongation of these assembly parts further assembly parts can be positioned and be held together by means of coupling elements 8.

Figures 2, 3:
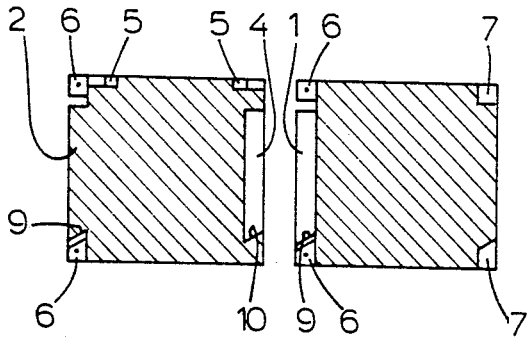
FIG. 2 shows a section according to line II—II in FIG. 1.
FIG. 3 shows a section according to line III—III in FIG. 1.

As appears clearly from FIG. 2 and 3, showing cross sections according to the lines II—II and III—III in FIG. 1, the lower side 9 of the side projections 1, 2 extends outwardly and inclined downwardly. Correspondingly the lower side 10 of the side recesses 3, 4 extends inwardly and inclined downwardly. As a result in the assembled situation the assembly parts can only be moved apart sidewardly if at the same time a displacement in the boundary plane between both assembly parts is carried out. Such a displacement however is prevented by the gravitational force. The way in which a side projection having an inclined lower side is applied into a side recess having an inclined lower side will later be illustrated with respect to FIG. 5.

As appears further from FIG. 3 the lower hole 7 comprises an inclined extending upper side, which during applying the side projections into the side recesses is necessary for applying the corresponding coupling part 6 into this hole 7.

Figure 4:
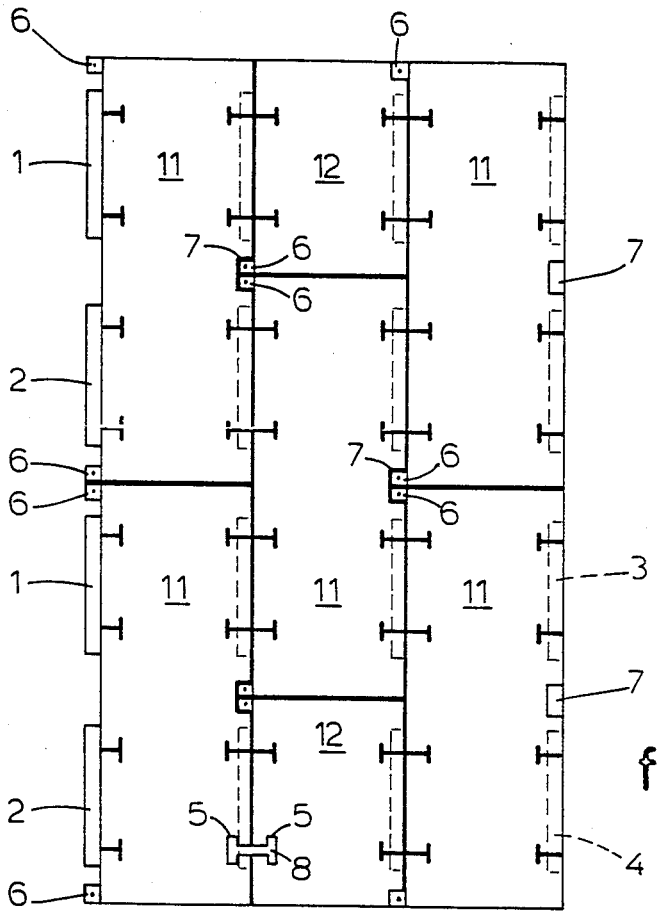
FIG. 4 shows a top plan view of a number of assembly parts as to a constructive assembly, and FIG. 5 the way in which two floating assembly parts are assembled.

The constructive assembly shown in FIG. 4 firstly comprises five assembly parts 11 corresponding with the assembly parts shown in FIG. 1. Further the constructive assembly comprises two assembly parts 12 that each as it were constitute one half of a separate assembly part shown in FIG. 1. It is visible clearly in which way the recesses 5 cooperate with the coupling elements 8 and in which way the coupling parts 6 are applied into the holes 7 (it is emphasized that in FIG. 4 only one coupling element 8 is represented fully; the remaining coupling elements are only schematically indicated). It appears that each hole 7 is fit for receiving two coupling parts 6 of aligned assembly parts. Like this the coupling parts 6 of the lengthy assembly parts 11 always can be accommodated in the present holes 7. The assembly parts 12 however can only at one end, namely as seen in FIG. 4 the inwardly directed end, be provided with coupling parts 6, for at the other end no recess 7 is provided in the assembly parts 11 adjoining the assembly parts 12. Herefore at these outer ends of the assembly parts 12 releasable coupling parts 6 are applied that, preceding the assembly of the constructive assembly, can be removed at those locations where this is necessary. If the constructive assembly has to be dismantled and the assembly parts 12 have to be transported as containers the coupling parts can be applied again at the said ends whereafter the outer dimensions of these assembly parts 12 again correspond with standard container dimensions.

Figure 5:
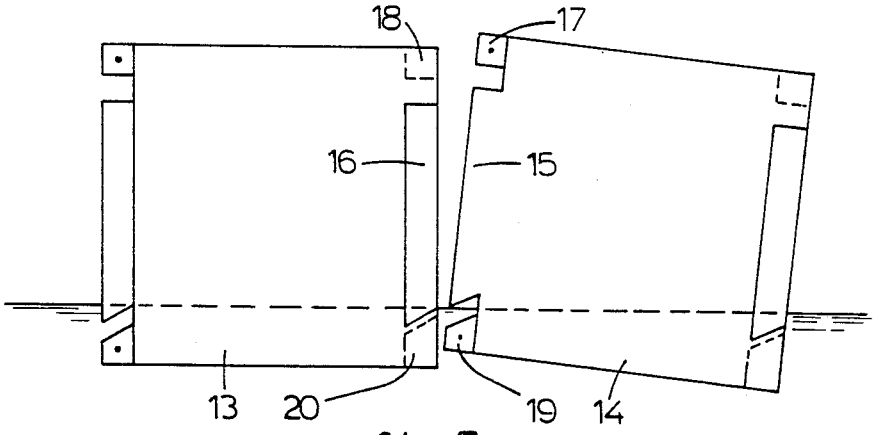

In FIG. 5 two assembly parts 13, 14 are shown that float in water. If the assembly part 14 is slightly tilted in the way shown, as is possibly by applying a downwardly directed force onto the right-handed side of this assembly part, it is possible to accommodate the side projection 15 of this assembly part 14 in the side recess 16 of the assembly part 14 (with respect hereto the inclined shape of the lower side o the projection 15 is advantageous too). This is carried out while at the same time rotating the assembly part 14 as seen in FIG. 5 anti-clockwise and displacing it into the direction of the assembly part 13. For easing this assembling it is possible that the side recess 16 and the side projection 15 are slightly bended at their upper side or that a wide fit is provided. Further for the assembly it is advantageous if the assembly part 14 comprises below the side projection 15 a slightly inclined inwardly extending lower side edge.

Simultaneously with applying the side projection 15 into the side recess 16 the coupling part 17 is applied into the hole 18 and the coupling part 19 is applied into the hole 20. After that the coupling elements not shown in FIG. 5 are accommodated in the recesses not represented too.

The force that has to be exerted onto the assembly part 14 for bringing it into the inclined position of FIG. 5 can be applied by a person standing on top of the assembly part 14 at the right-handed side edge. Moreover it is possible that from a vessel such a force is exerted by means of a lever.

The coupling elements 8 that are provided for holding together the assembly parts have such a weight that they are positively secured in the recesses 5 by means of the gravitational force. During joining the assembly parts initially light coupling elements can be applied that can be replaced by heavier coupling elements when a sufficient number of assembly parts have been joined for forming a stable floating constructive assembly.

Besides of the shown and described floating embodiment of the constructive assembly it is possible too that the constructive assembly is applied as a self-supported construction that is supported at its ends.

The invention is not limited to the embodiment described before, but can be varied widely within the scope of the invention.

I claim:

1. A construction assembly made up of a plurality of connected assembly parts comprising:

a plurality of separate assembly parts, each of which is buoyant and has a positive meta center height, comprising a first side provided with at least one side projection projecting outwardly from a surface defined by said first side, a second side parallel to said first side which defines a second surface which defines at least one side recess which is depressed from said second surface, each of said at least one side projections and each of said at least one side recesses being shaped such that a side projection of a first assembly part can be releasably gripped by a side recess of a second assembly part which is positioned next to said first assembly part when at least one of said first and second assembly parts is tilted and said side projection is inserted into said side recess, and a top face having top face margins at least some of which define at least one locking recess with a closed end and an open end such that when said first and second assembly parts are assembled a first open end of a locking recess of said first assembly part will be aligned with a second open end of a second locking recess of said second assembly part; and a releasable coupling element shaped to substantially correspond to the space defined by said first and second locking recesses when aligned, said releasable coupling element to be positioned within said first and second locking recesses when aligned thereby affixing said first assembly part to said second assembly part.

2. The assembly as set forth in claim 1, wherein each of said at least one side projections has a lower section which, in addition to extending outwardly, inclines downwardly to correspond to a lower section of each of said at least one side recessions which, in addition to extending inwardly, inclines downwardly.

3. The assembly as set forth in claim 1, wherein each assembly part further comprises at least two side projections regularly spaced on said first side and at least two side recesses correspondingly spaced on said second side as well as at least two locking recesses regularly spaced on said top face margins.

4. The assembly as set forth in claim 3, wherein each assembly part comprises two side projections, two side recesses and, at each top face margin which faces an adjoining assembly part, two locking recesses.

5. The assembly as set forth in claim 1, wherein each of said at least one locking recesses is narrower at its open end than it is at its closed end.

6. The assembly as set forth in claim 5, wherein each of said at least one locking recesses is T-shaped.

7. The assembly as set forth in claim 1, wherein said first side of each assembly part has four corners each of which is provided with an outwardly projecting coupling part said coupling parts combining with said second side to define the outer dimensions of said assembly part, said second surface defined by said second side further defining four holes for receiving said coupling parts when assembling a first and a second assembly part.

8. The assembly construction as set forth in claim 1, wherein said separate assembly parts are constructed to form a floating pontoon-like assembly.

9. The assembly construction as set forth in claim 1, wherein said separate assembly parts have outer dimensions which correspond with the outer dimensions of standardized containers.

* * * * *